US006595902B1

(12) United States Patent
Savage et al.

(10) Patent No.: US 6,595,902 B1
(45) Date of Patent: Jul. 22, 2003

(54) WEIGHT TRAINING AND TONING DEVICE

(76) Inventors: Michael J. Savage, 15 MacArthur Dr., Millbury, MA (US) 01527; Lev Shulyak, 22 Buckley Rd., Worcester, MA (US) 01602

( * ) Notice: Subject to any disclaimer, the term of this patent is extended or adjusted under 35 U.S.C. 154(b) by 79 days.

(21) Appl. No.: 09/928,572

(22) Filed: Aug. 13, 2001

Related U.S. Application Data

(62) Division of application No. 09/372,877, filed on Aug. 12, 1999, now Pat. No. 6,273,846.

(51) Int. Cl.[7] ..... A63B 21/06

(52) U.S. Cl. ..... 482/94; 482/102; 482/106; 482/142

(58) Field of Search ..... 482/93, 94, 98–104, 482/106–109, 138, 142

(56) References Cited

U.S. PATENT DOCUMENTS

| | | | | | |
|---|---|---|---|---|---|
| 2,436,987 | A | | 3/1948 | Bailleaux | |
| 2,632,645 | A | | 3/1953 | Barkschat | |
| 2,733,922 | A | * | 2/1956 | Diego | 482/96 |
| 3,309,084 | A | * | 3/1967 | Simmons | 482/62 |
| 4,369,966 | A | * | 1/1983 | Silberman et al. | 482/104 |
| 4,431,181 | A | | 2/1984 | Baswell | |
| 4,477,074 | A | * | 10/1984 | Bushnell | 482/108 |
| 4,834,396 | A | * | 5/1989 | Schnell | 482/97 |
| 4,932,654 | A | * | 6/1990 | Batca | 482/104 |
| 4,955,603 | A | | 9/1990 | Becker | |
| 5,062,631 | A | | 11/1991 | Dau et al. | |
| 5,078,392 | A | | 1/1992 | Kracht | |
| 5,135,451 | A | * | 8/1992 | Chen | 482/98 |
| 5,298,004 | A | * | 3/1994 | Davis | 482/99 |
| 5,575,742 | A | | 11/1996 | Wu | |
| 5,725,459 | A | | 3/1998 | Rexach | |
| 5,836,858 | A | | 11/1998 | Sharff | |
| 5,839,991 | A | | 11/1998 | Hall | |
| 6,273,846 | B1 | * | 8/2001 | Savage et al. | 482/106 |
| 6,350,221 | B1 | * | 2/2002 | Krull | 482/142 |
| 6,416,446 | B1 | * | 7/2002 | Krull | 482/108 |

FOREIGN PATENT DOCUMENTS

| | | | |
|---|---|---|---|
| EP | 0300206 A1 | * | 1/1989 |
| FR | 2561528 A1 | * | 9/1985 |
| FR | 2630652 | * | 11/1989 |

* cited by examiner

*Primary Examiner*—Jerome W. Donnelly
*Assistant Examiner*—Victor Hwang
(74) *Attorney, Agent, or Firm*—Blodgett & Blodgett, P.C.

(57) ABSTRACT

A weight training and toning device that has a frame which supports a horizontal platform. A roller assembly is mounted on the frame for movement between an inactive position to an active position. When the roller is in the active position, the device is supported on the roller and can be rolled easily from one location to another location. More specifically, a pulley stand is attached to the bench and storage racks for weight plates and barbell assemblies are supported on the frame.

17 Claims, 8 Drawing Sheets

WEIGHT TRAINING AND TONING DEVICE

CROSS-REFERENCE TO RELATED APPLICATIONS

This application is a division of U.S. Ser. No. 09/372,877, filed Aug. 12, 1999, issued as U.S. Pat. No. 6,273,846 on Aug. 14, 2001.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The present invention is directed generally to a physical fitness device and, more specifically, to a device which provides for weight training and toning.

A wide variety of physical fitness apparatus is available for enabling individuals to develop and/or tone muscles. Most exercise devices are designed for a specific group of muscles. For those individuals who wish to develop or tone all muscle groups they must use several of these devices or machines. Since the total cost for all of the machines required for complete training program is prohibitive for most individuals, they must join a physical fitness center, club, or gym which employs a full set of such devices or machines. Although the cost of joining a physical fitness center is considerably less than the cost of the machines, it is still substantial. The individual must also travel to and from the exercise facility. This makes it difficult for a person to fit the travel and exercise time into his or her daily schedule. In addition, the exercise period must be within the hours that the exercise facility is open. Finally, the individual must compete with other individuals at the facility for the opportunity to use specific machines.

Some exercise devices have been promoted as being able to provide universal or multiple muscle group training. The devices which claim to provide multiple training capabilities are generally expensive, cumbersome and complicated to adjust for the different types of exercises which can be performed on the device. Devices which are relatively simple and easy to use also tend to be limited in the types of exercises which can be performed with such devices.

Many individuals prefer to use "free weights" for toning and weight training. Training with free weights can be performed with a bar or bars, weight plates, a bar stand, and a bench. "Free weight" equipment is affordable for most individuals, is simple, easy to use and can be used in the home. Storage of "free weight" equipment is still a problem and is somewhat inconvenient to move from a storage area to an exercise area. As a result, "free weight" equipment is usually regulated to the basement or garage and, to some degree, represents an inconvenience. Currently available typical "free weight" equipment is quite difficult to deal with for most women and elderly individuals. Also, most women do not like to spend time in garages or basements for any activity, particularly exercising. Finally, women do not find traditional "free weight" equipment to be attractive, particularly if it is to be deployed in a family room or other comparable space in the home. These and other difficulties experienced with the prior art weight training and toning devices have been obviated by the present invention.

It is, therefore, a principal object of the invention to provide a weight training and toning device which is versatile and easy to use.

A further object of the present invention is the provision of a weight training and toning device which combines traditional free weight equipment with machine technology and which can be moved easily to and from a storage location and an exercise location.

Another object of the invention is the provision of a weight training and toning device which is compact and attractive.

Another object of the invention is the provision of a barbell assembly which is easy to assemble and disassemble.

A still further object of the invention is the provision of weight training and toning device which is relatively inexpensive and capable of a long life of useful service.

Still another object of the present invention is the provision of a weight training and toning device which is particularly adapted for use by women.

A still further object of the invention is the provision of a weight training and storage device, which includes a compact and conveniently accessible storage rack for weight plates.

With these and other objects in view, as will be apparent to those skilled in the art, the invention resides in a combination of parts set forth in the specification covered by the claims appended hereto.

BRIEF SUMMARY OF THE INVENTION

In general, the invention consists of a weight training and toning device that has a frame which supports a horizontal platform. A roller assembly is mounted on the frame for enabling the device to move easily from one location to another location. The roller assembly is normally in an inactive state and can be selectively activated. More specifically, a pulley stand is attached to the bench and a storage rack for weight plates is supported in the frame. The invention also includes a novel barbell assembly adapted to be stored on the storage rack.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
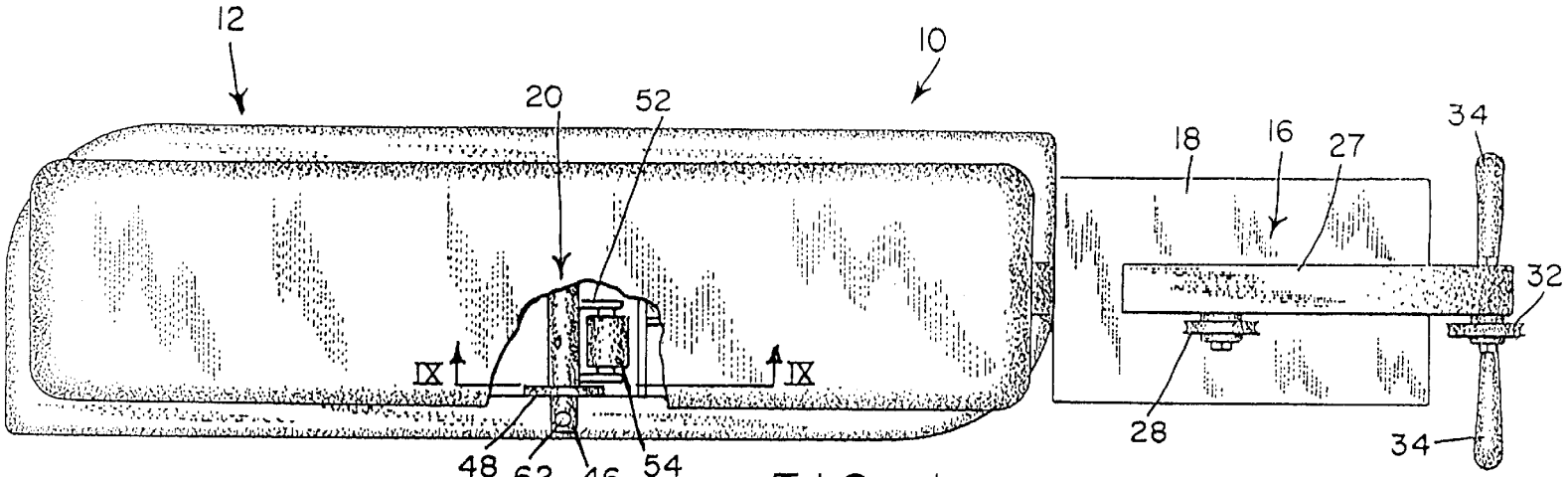
FIG. 1 is a top plan view of a weight training and toning device embodying the principals of the present invention.
Figure 2:
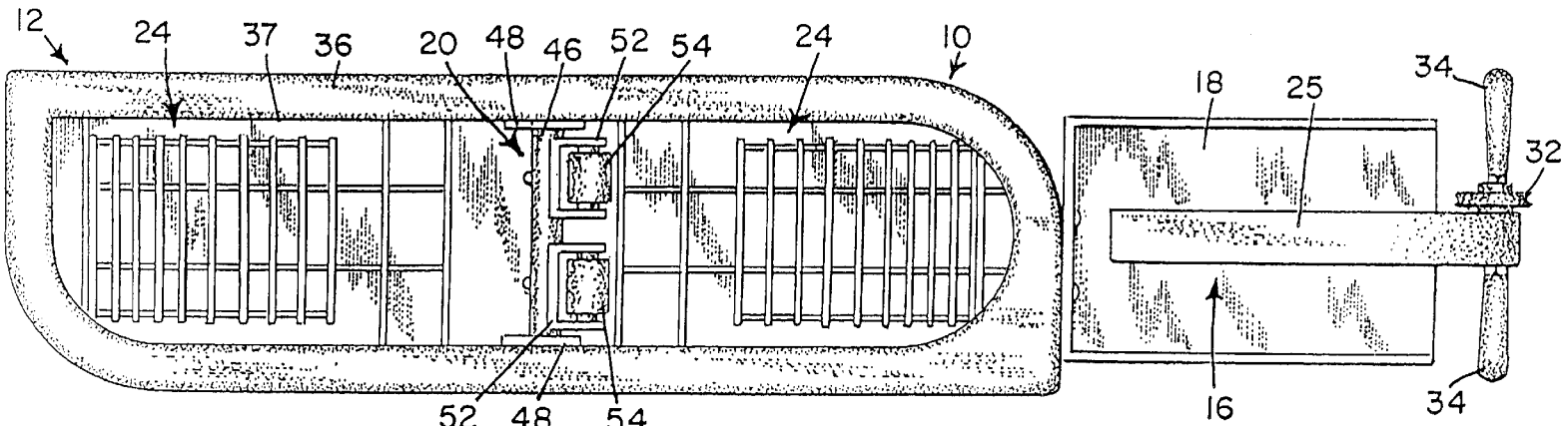
FIG. 2 is a bottom plan view of the weight training and toning device.

Referring first to FIGS. 1–6 and 11, the weight training and toning device of the present invention is generally indicated by the reference numeral 10 and comprises a supporting frame, generally indicated by the reference numeral 12, an upper platform 14 supported on the supporting frame, a pulley stand, generally indicated by the reference numeral 16, storage racks, generally indicated by the reference numeral 24, and barbell assemblies, generally indicated by the reference numeral 72.

Figure 11:
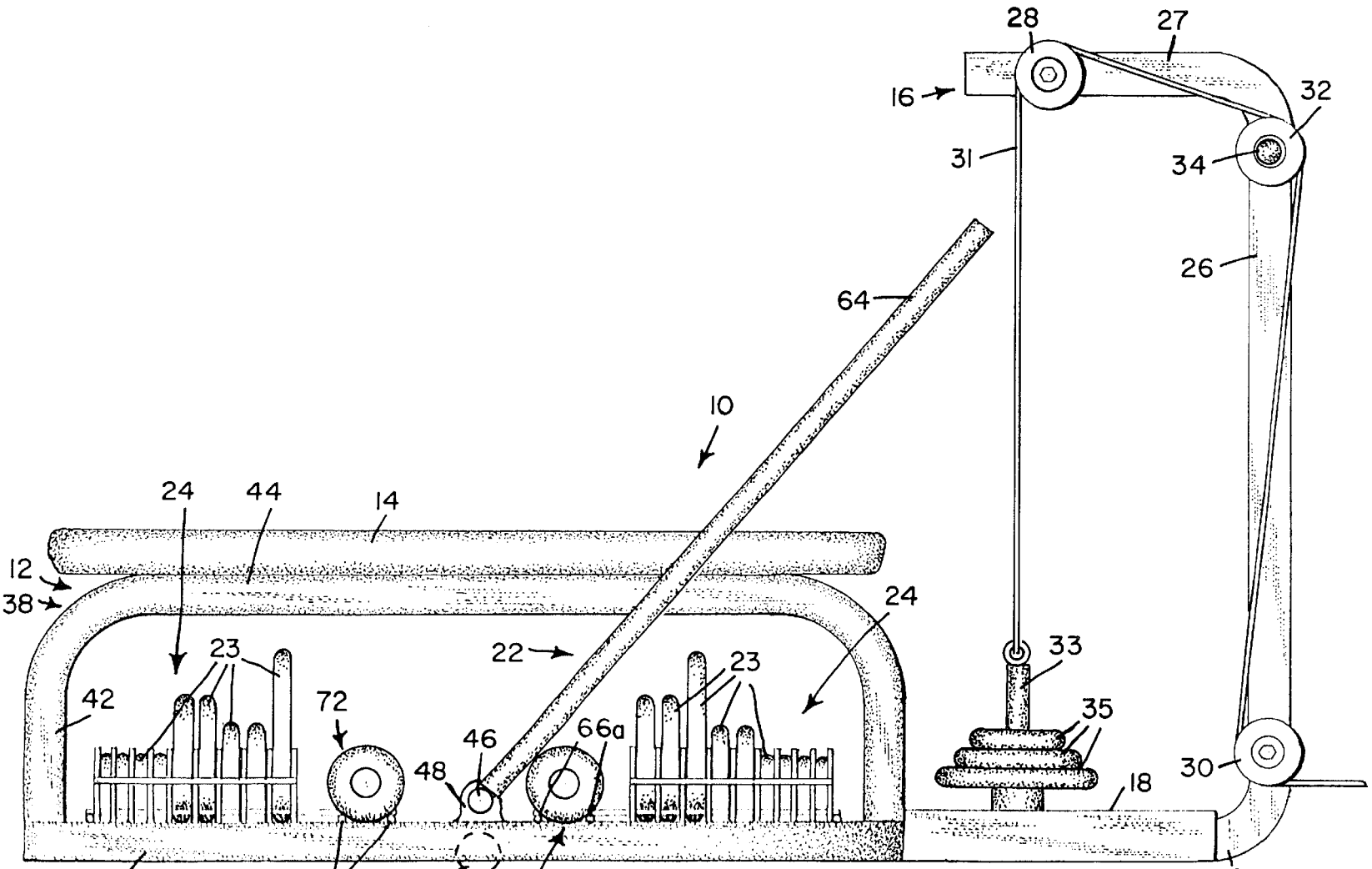
FIG. 11 is a front elevational view of the weight training and toning device of the present invention, with the addition of weight plates and barbells which also form part of the weight training and toning device of the present invention.

As illustrated in FIG. 11, the storage racks 24 are designed to hold a plurality of weight plates 23. The pulley stand 16 includes a lower horizontal arm 25, an upper horizontal arm 27, and a vertical arm 26. The lower horizontal arm 25 is fixed to a lower platform 18 which is, in turn, fixed to the supporting frame 12. An upper sheave 28 is rotatably mounted on the upper arm 27. A lower sheave 30 is rotatably mounted on the lower portion of the vertical arm 26. An intermediate sheave 32 is rotatably mounted on the upper portion of the vertical arm 26. One end of a cable 31 is connected to a peg 33 and is trained around the sheaves 28, 32, and 30, as shown in FIG. 11. The opposite end of the cable 31 is connected to any conventional attaching device, such as an ankle strap, not shown. The peg 33 is adapted to receive one or more weight plates, such as those indicated by the reference numeral 35 in FIG. 11. The peg 33 and weights 35 are supported on the lower platform 18. The pulley stand 16 is provided with a pair of oppositely extending handles 34. The handles 34 can be grasped by an individual while lifting the weights 35 for a variety of leg exercises.

The supporting frame 12 comprises a generally rectangular base portion 36 which has a generally rectangular opening 37. The frame 12 also includes an inverted U-shaped bracket, generally indicated by the reference numeral 38 fixed to the base portion 36. The bracket 38 comprises has a first vertical leg portion 40, a second vertical leg portion 42, and an upper horizontal portion 44 which supports the upper platform 14. The upper surface of the upper platform 14 is provided with a cushioning material, such as thermoplastic foam. The upper platform 14 is covered with a fitted cover which extends around the edges and below the periphery of the platform. The upper platform 14 is supported by the upper horizontal portion 44 of the frame in a manner which enables a portion of the undersurface of the platform to be exposed along its entire periphery to facilitate the application of a form fitted slip cover. The slip cover can be applied to the platform quite easily and is easily replaced. Also the slip cover can be selected for its decorative features to match the decor of a particular room.

The weight training and toning device 10 also includes a roller assembly, generally indicated by the reference numeral 20, and an actuator for the roller assembly, generally indicated by the reference numeral 22. The roller assembly 20 includes a horizontal shaft 46 and a pair of rollers 54. The shaft 46 is rotatably mounted between two bearing brackets 48 fixed to the base 36 by fasteners 50. Each roller 54 is rotatably mounted on a horizontal shaft 56 which extends between a pair of spaced arm portions of an inverted U-shaped bracket 52 fixed to the shaft 46. The shaft 46 and brackets 52 represent a lever system for supporting the rollers 54. The rollers 54 are shown in their inactive position in FIG. 9, wherein the rollers 54 rests on the floor.

Figure 3:
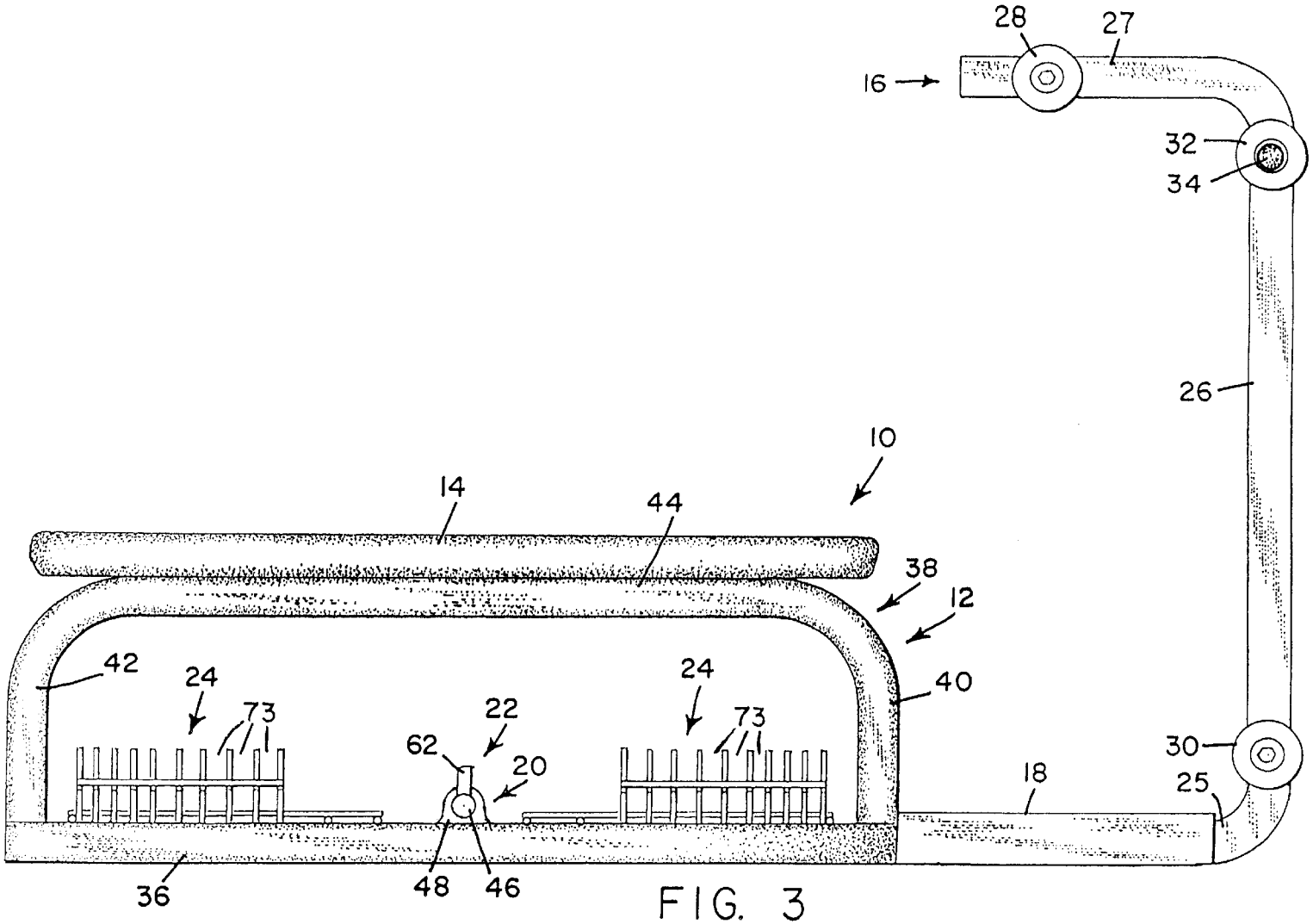
FIG. 3 is a front elevational view of the weight training and toning device.
Figure 4:
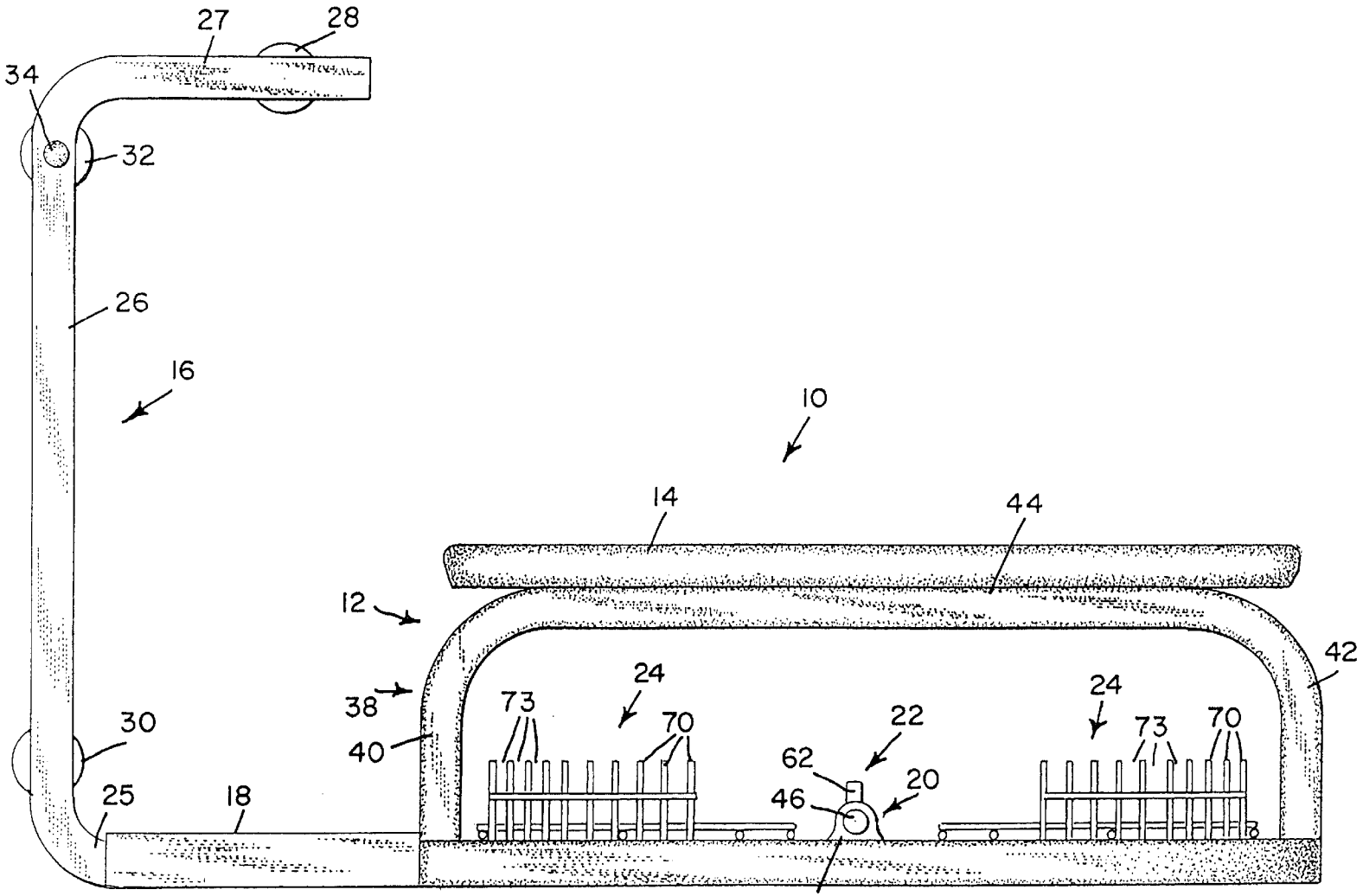
FIG. 4 is a rear elevational view of the weight training and toning device.
Figure 5:
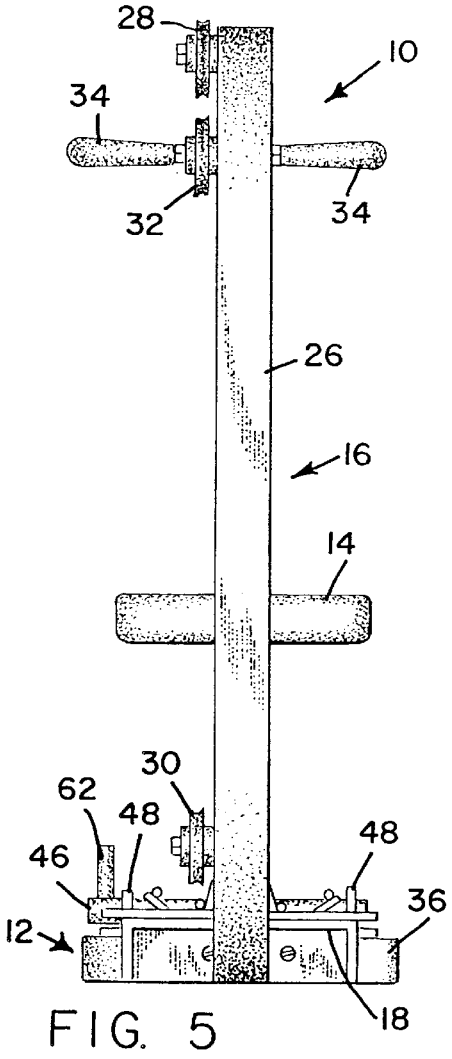
FIG. 5 is a right side elevational view of the weight training and toning device.
Figure 6:
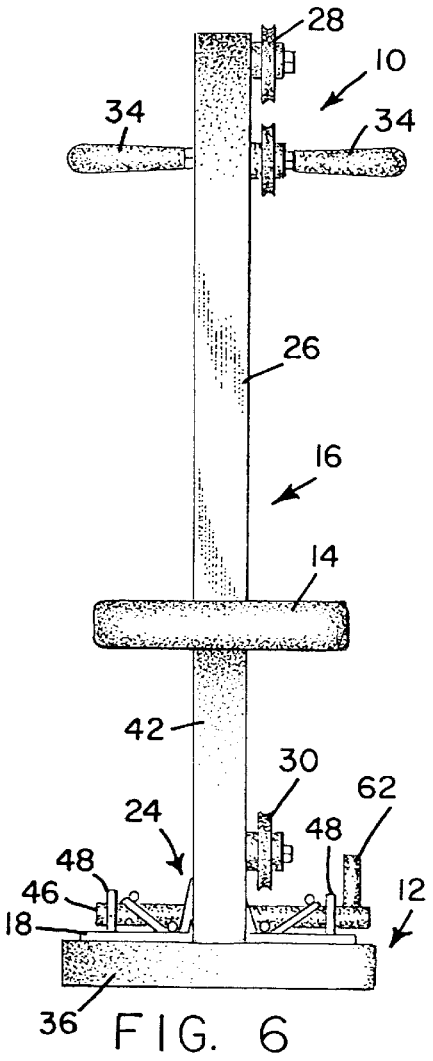
FIG. 6 is a left side elevational view of the weight training and toning device.
Figure 9:
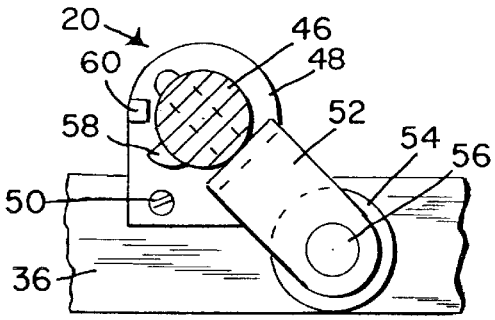
FIG. 9 is a fragmentary vertical cross sectional view of a roller assembly which forms part of the weight training and toning device of the present invention, showing the roller assembly in an inactive position.
Figure 10:
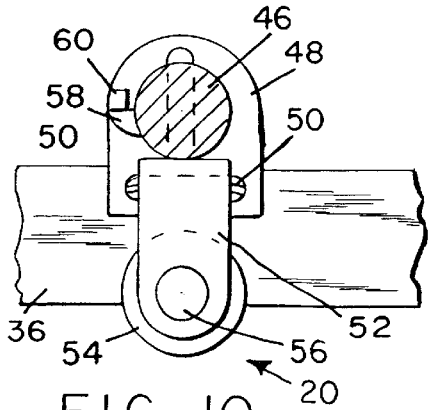
FIG. 10 is a view similar to FIG. 9, showing the roller assembly in an active position.

Referring particularly to FIGS. 1 and 3, the actuator 22 comprises a handle 62 which is fixed to the upper end of the shaft 46 at the front end of the frame 12. The roller assembly 20 can be moved from its inactive position, shown in FIG. 9, to its active position shown in FIG. 10, by moving the handle 62 to the right as viewed in FIG. 3. When the roller assembly 20 is in its active position, as shown in FIG. 10, the lower portions of the rollers 54 extend below the lower surface of the base 36 so that all of the weight of the weight training and toning device 10 is supported on the rollers 54. The actuation of the lever 62 is facilitated by the use of an elongated bar 64. The bar 64 is similar to one of the bars used for forming the barbell assembly 72 which also forms part of the present invention. The bar 64 has at least one end opening for receiving the lever 62. This enables the user of the device 10 to move the rollers 54 to the active position shown in FIG. 10 without having to stoop down. The shaft 46 is equipped with a projecting finger 58 which engages a stop 60 attached to one of the brackets 48, as shown in FIGS. 9 and 10. This prevents the roller 54 from moving beyond the center position, shown in FIG. 10, when the roller is moved from the inactive position to the active position. The user can then move the weight training and toning device 10 to another position on the floor or other supporting surface with ease by simply grasping one of the handles 34 and/or the bar 64 and pushing the device 10 to a new position on the floor. Thereafter, the rollers 54 are returned to their normal inactive position so that the bottom surface of the base 36 rests on the floor.

Figure 7:
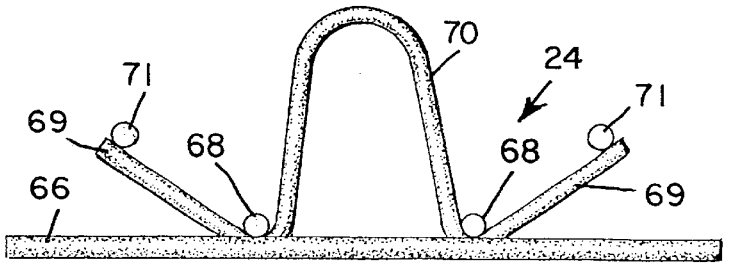
FIG. 7 is an end view of one of the storage racks for weight plates which forms part of the weight training and toning device of the present invention.
Figure 8:
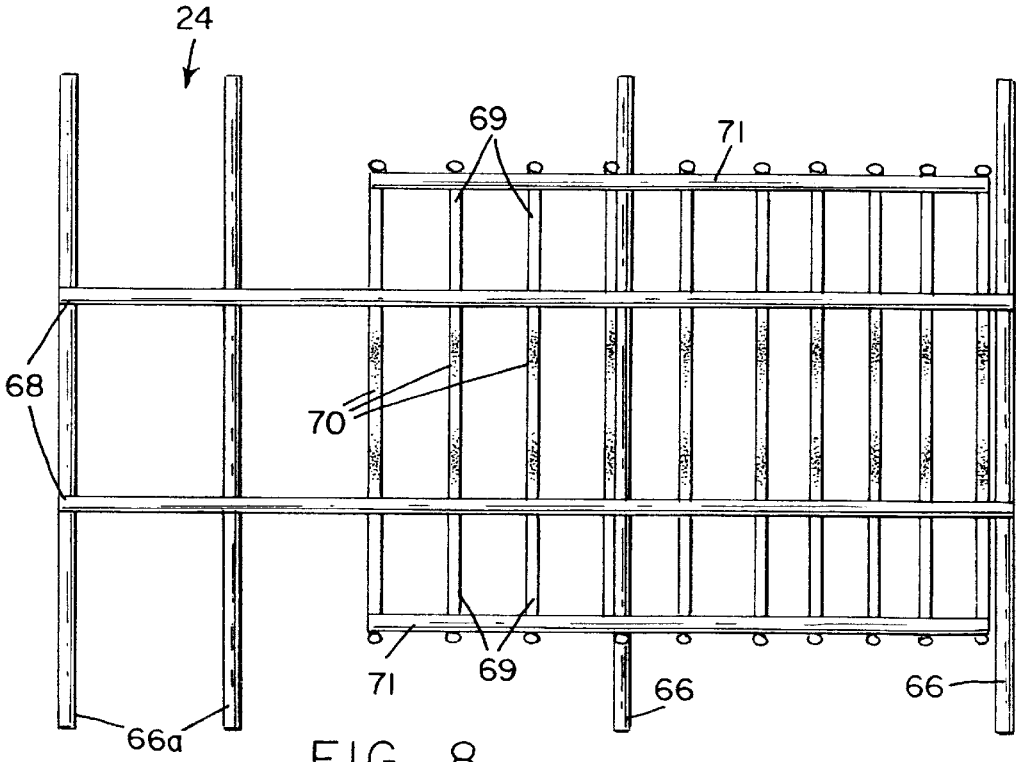
FIG. 8 is a top plan view of the storage rack.

Referring particularly to FIGS. 3, 7, and 8, the storage rack 24 comprises a plurality of spaced first horizontal rods 66 and a pair of spaced second horizontal rods 68 fixed to the rods 66 and extending transversely to the rods 66. A plurality of inverted U-shaped rods 70 are fixed the second horizontal rod 68. Each U-shaped rod 70 has a pair of oppositely extending free end portion 69 which extend upwardly and outwardly from one of the second horizontal rods 68, as shown in FIG. 7. A plurality of third horizontal rods 71 are fixed to the outer ends of the free end portions 69 so that the rods 71 are parallel to the second horizontal rods 68 and transverse to the first horizontal rods 66. The spaces between the U-shaped rod 70 form slots, generally indicated by the reference numeral 73, as shown in FIG. 3, for receiving weight plates 23, as shown in FIG. 11. The rods 71 and 68 also form a cradle for supporting the weight plates. Also, as shown in FIG. 11, an adjacent pair, 66*a*, of the first horizontal rods 66 which are free of the U-shaped rods 70 also forms a cradle for one of the barbell assemblies 72 to be described.

Referring to FIGS. 12–16, the barbell assembly 72, includes an elongated cylindrical tubular bar, generally indicated by the reference numeral 74, for supporting a plurality of weight plates 75. The bar 74 has a cylindrical bore 76 and end openings 78 for receiving plugs 80. A pair of spaced stops, generally indicated by the reference numeral 77, divide the bar 74 into a middle portion 82, a first end portion 84, and a second end portion 86. Each of the first and second end portions 84 and 86, respectively, contains a pair of apertures 88 which extend transversely of the central longitudinal axis of the bar. Each stop 77 comprises a collar 90 fixed to the bar 74 by a fastener 92. A sleeve of thermoplastic material 106 extends between the stops 77. The sleeve 106 is preferably made of a foam thermoplastic material to provide comfort to the user. Each weight plate 75 has a central bore 89 which enables the weight plate to be inserted over the end of the bar 74 to one of the stops 77. The weight plate 75 is maintained against the stop 77 by a retaining pin, generally indicated by the reference numeral 79.

Figure 12:
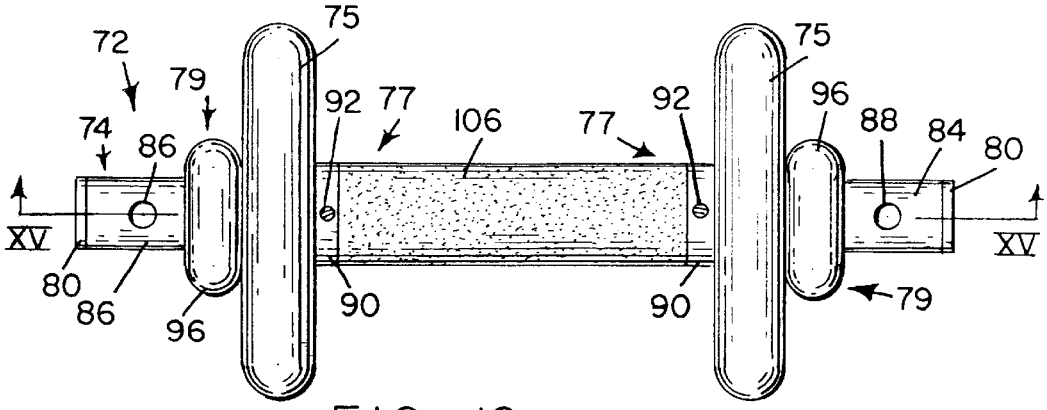
FIG. 12 is a top plan view of one of the barbells of the present invention shown with a single pair of weight plates.
Figure 13:
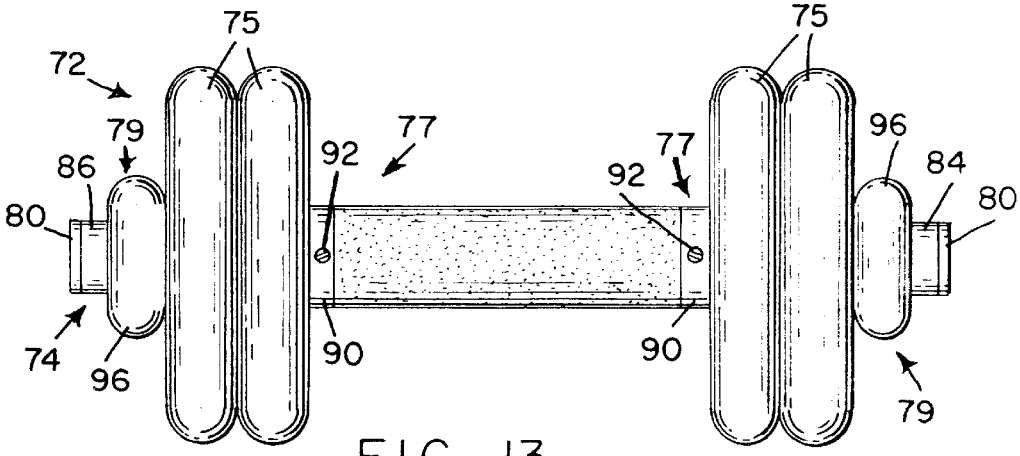
FIG. 13 is a view similar to FIG. 12, shown with two pairs of weight plates.
Figure 15:
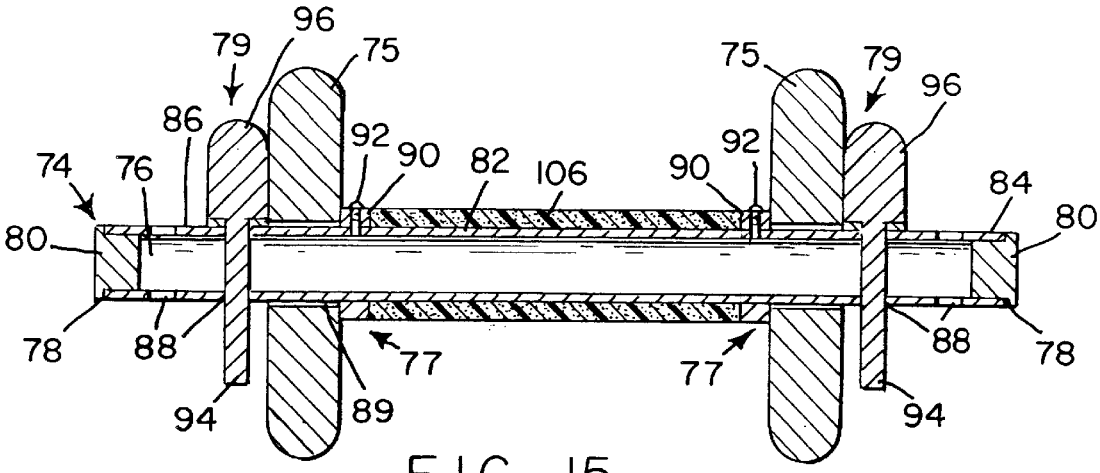
FIG. 15 is a vertical cross sectional view of the barbell, taken along line XV—XV of FIG. 12 and looking in the direction of the arrows.
Figure 17:
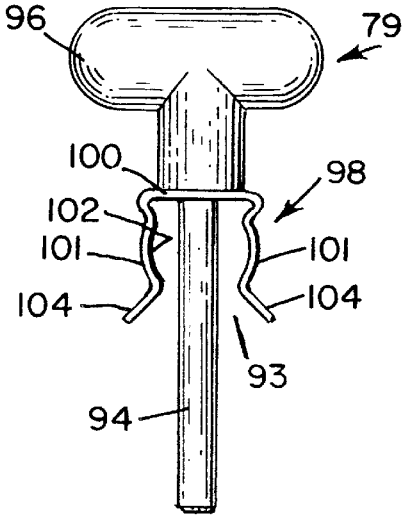
FIG. 17 is a side elevational view of the retaining pin, looking in the direction of arrow XVII of FIG. 16.
Figure 16:
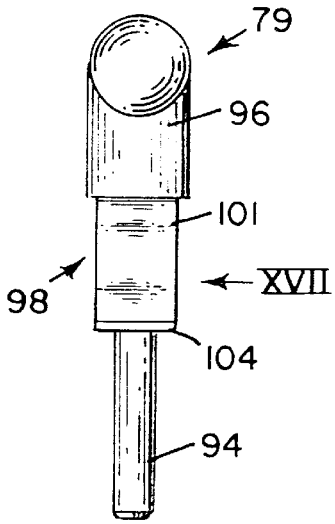
FIG. 16 is a front elevational view of the retaining pin portion of the barbell.

Referring particularly to FIGS. 16 and 17, each retaining pin 79 includes a rod 94 and a T-shaped handle 96. The rod 94 is inserted into one of the openings 98 nearest the weight plate 75 so that the weight plate is maintained snugly between the stop 77 and the retaining pin 79. If two weight plates 75 are applied to each end of the bar 74, as shown in FIG. 13, the retaining pin 79 is inserted into the outermost aperture 88 at each end of the bar so that both weight plates 75 are held snugly against the retaining pin and the stop 77, as shown in FIG. 13. The barbell assembly 72 of the present invention includes additional weight plates all of which have the same thickness as the weight plates 75. However, the additional weight plates vary in diameter, as illustrated by the weight plate 23 and 35 as shown in FIG. 11. The weight plates are made of the same material so that the weight plates which have larger diameters weigh more than the weight plates having smaller diameters. At least two weight plates of the same diameter are required for each barbell assembly. However, additional weight plates of the same diameter can also be included in the collection of weight plates. The racks 24 are also adapted to hold weight plates having different thicknesses for purposes other than for use with the barbell assemblies 72. The thickness of each weight plate 75 is equal to the distance between the central longitudinal axis of the two adjacent apertures 88 at each end of the bar. The barbell example shown in FIGS. 12, 13, and 15 is a relatively short barbell assembly which has two apertures 88 at each end of the bar. If a longer bar is employed, such as bar 64, each end of the bar is provided with additional apertures 88.

Figure 14:
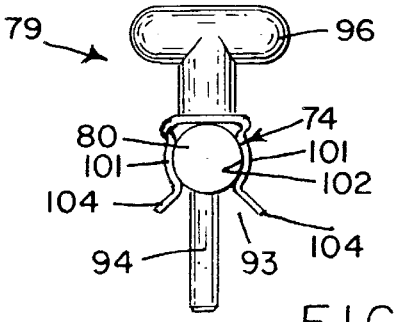
FIG. 14 is an end view of the barbell of FIG. 12, looking in the direction of arrow XIV of FIG. 12.

Referring particularly to FIGS. 14, 16, and 17, each retaining pin 79 is provided with a releasable holder, generally indicated by the reference numeral 98, for maintaining the retaining pin in a retaining position on the bar 74. The releasable holder 98 comprises a U-shaped spring clip having a base 100 which is secured to the rod 94 and a pair of spaced fingers 101. Each finger 101 has a concave inwardly facing surface 102 and a free end 104 which extends outwardly away from the base 100. The retaining pin 79 is applied to the shaft 74 by inserting the rod 94 through one of the apertures 88 so that the bar 74 enters the opening of the releasable holder 98 defined by the free ends 104. Pressure applied to the handle 96 toward the shaft 74 forces the resilient fingers 101 apart so that the shaft enters the spring clip opening 103 defined by the fingers 101 and engages the concave surfaces 102. Since the fingers 101 are resiliently yieldable, they are biased against the outer surface of the shaft 74 and maintain the shaft within the spring clip and, thereby, retain the retaining pin 79 on the bar 74.

The invention having been thus described, what is claimed is new and desired to secure by Letters Patent:

1. An exercise and toning device comprising:

(a) a supporting frame having a bottom surface for resting on a floor;

(b) a platform fixed to said supporting frame, said platform having a flat upper surface for supporting a person in either a prostrate position or in a sitting position;

(c) a roller assembly which includes at least one roller, said roller assembly being mounted on said frame for movement between an inactive position in which said roller is above the bottom surface of said supporting frame and an active position in which at least a portion of said roller is below said bottom surface, said roller assembly being normally in said inactive position;

(d) an actuator for moving said roller assembly from inactive position to said active position so that said device is supported on said roller to enable said device to be rolled on said floor; and (e) a storage rack for weight plates, said storage rack having a plurality of vertical slots for receiving weight plates, said storage rack comprises:

(i) a plurality of spaced first horizontal rods;

(ii) a plurality of spaced second horizontal rods fixed to and extending transversely to said first horizontal rods; and (iii) a plurality of spaced inverted u-shaped rods fixed to at least some of said first horizontal rods and extending transversely of said first horizontal rods, spaces between adjacent ones of said inverted u-shaped rods defining said vertical slots.

2. An exercise and toning device as recited in claim 1, wherein said roller assembly comprises:

(a) a lever having a first end mounted to said frame for pivoting movement about a horizontal axis, said lever having a free second end for supporting said roller so that said roller is horizontally offset to a vertical axis extending through said horizontal axis when said roller assembly is in said inactive position for enabling said roller to rest on the floor said roller being substantially vertically aligned with said horizontal axis when said roller assembly is in said active position; and (b) a handle operatively connected to said lever for enabling said roller assembly to be moved to said active position.

3. An exercise and toning device as recited in claim 2, further comprising a stop on said supporting frame which prevents said roller assembly from being pivoted beyond said active position when said roller assembly is moved from said inactive position to said active position.

4. An exercise and toning device as recited in claim 3, wherein said handle comprises:

(a) an upwardly extending finger fixed to said lever; and (b) an elongated bar having one end detachably connected to said finger, said bar enabling a person to move said roller assembly to said active position and to push said device in a rolling mode along the floor, said elongated bar also being adapted to function as a supporting bar for weight plates when said bar is not used as part of said lever.

5. An exercise and toning device as recited in claim 4, wherein said one end of said bar has a bore for receiving said finger.

6. An exercise and toning device as recited in claim 2, wherein said lever comprises:

(a) a shaft mounted on said supporting frame for rotation about said horizontal axis; and (b) a bracket fixed to said shaft and rotatably supporting said roller.

7. An exercise and toning device as recited in claim 1, wherein said supporting frame comprises:

(a) a substantially rectangular base having a vertical opening which is located so that said roller being located within said vertical opening; and (b) an inverted u-shaped bracket having a first leg portion fixed to one end of said base, a second leg portion fixed to the opposite end of said base and a horizontal portion vertically spaced from said base and supporting said platform, said bracket defining with said base a horizontal opening.

8. An exercise and toning device as recited in claim 1, further comprising a pulley stand attached to said supporting frame, said pulley stand extending above said platform for enabling said pulley stand to be grasped by a person for moving said device along the floor when said roller assembly is in said active mode.

9. An exercise and toning device as recited in claim 8, wherein said pulley stand comprises:

(a) a lower horizontal arm having an inner end attached to said supporting frame and extending away from said supporting frame to an outer end;

(b) a vertical arm fixed to the outer end of said lower horizontal arm and having an upper end above said platform;

(c) an upper horizontal arm fixed to the upper end of said vertical arm and extending toward said platform; and (d) at least one sheave rotatably mounted on said pulley stand.

10. An exercise and toning device as recited in claim 9, wherein said platform is an upper platform and said lower horizontal arm is a lower platform, and said sheave is mounted on said upper horizontal arm in vertical alignment with said lower platform.

11. An exercise and toning device as recited in claim 10, wherein said sheave is an upper sheave and said pulley stand further comprises a lower sheave rotatably mounted on said vertical arm adjacent said lower horizontal arm.

12. An exercise and toning device as recited in claim 1, wherein each of said inverted u-shaped rods has an upper end and a pair of spaced lower ends fixed to a pair of said first horizontal rods, each of said lower ends extending upwardly and outwardly from a respective one of said pair of first horizontal rods to a free end which higher than said second horizontal rods and lower than the upper ends of said inverted u-shaped rods, said storage rack further comprising a pair of spaced third horizontal rods extending parallel to said first horizontal rods and fixed to the free ends of said inverted u-shaped rods, said pair of first horizontal rods and said pair of third horizontal rods forming a cradle for supporting a weight plate.

13. An exercise and toning device comprising:

(a) a supporting frame having a bottom surface for resting on a floor;

(b) a platform fixed to said supporting frame, said platform having a flat upper surface for supporting a person in either a prostrate position or a sitting position;

(c) a pulley stand attached to said supporting frame, said pulley stand extending above said platform; and (d) a storage rack for weight plates, said storage rack having a plurality of vertical slots for receiving weight plates, said storage rack comprising:

(i) a plurality of spaced first horizontal rods;

(ii) a plurality of spaced second horizontal rods fixed to and extending transversely to said first horizontal rods; and (iii) a plurality of spaced inverted u-shaped rods fixed to at least some of said first horizontal rods and extending transversely of said first horizontal rods, spaces between adjacent ones of said inverted u-shaped rods defining said vertical slots.

14. An exercise and toning device as recited in claim 13, wherein each of said inverted u-shaped rods has an upper end and a pair of spaced lower ends fixed to a pair of said first horizontal rods, each of said lower extending upwardly and outwardly from a respective one of said pair of first horizontal rods to a free end which higher than said second horizontal rods and lower than the upper ends of said inverted u-shaped rods, said storage rack further comprising a pair of spaced third horizontal rods extending parallel to said first horizontal rods and fixed to the free ends of said inverted u-shaped rods, said pair of first horizontal rods and said pair of third horizontal rods forming a cradle for supporting a weight plate.

15. An exercise and toning device as recited in claim 13, wherein said pulley stand comprises:

(a) a lower horizontal arm having an inner end attached to said supporting frame and extending away from said supporting frame to an outer end;

(b) a vertical arm fixed to the outer end of said lower horizontal arm and having an upper end above said platform;

(c) an upper horizontal arm fixed to the upper end of said vertical arm and extending toward said platform; and (d) at least one sheave rotatably mounted on said pulley stand.

16. An exercise and toning device as recited in claim 15, wherein said platform is an upper platform and said lower horizontal arm is a lower platform, and said sheave is mounted on said upper horizontal arm in vertical alignment with said lower platform.

17. An exercise and toning device as recited in claim 16, wherein said sheave is an upper sheave and said pulley stand further comprises a lower sheave rotatably mounted on said vertical arm adjacent said lower horizontal arm.

* * * * *